United States Patent [19]

DeLucia

[11] 4,354,728

[45] Oct. 19, 1982

[54] ELECTRICAL CONTACTOR FOR TERMINAL PIN

[76] Inventor: Victor E. DeLucia, 11846 Mississippi Ave., Los Angeles, Calif. 90025

[21] Appl. No.: 136,258

[22] Filed: Apr. 1, 1980

[51] Int. Cl.[3] ..... H01R 4/48

[52] U.S. Cl. ..... 339/256 S; 338/332; 339/276 F

[58] Field of Search ..... 339/256 S, 256 R, 256 T, 339/248 R, 248 S, 228, 276 F; 338/332; 361/310; 174/173

[56] References Cited

U.S. PATENT DOCUMENTS

| | | | |
|---|---|---|---|
| 187,183 | 2/1877 | Seiler | 174/173 |
| 1,874,744 | 8/1932 | Hathorn | 338/332 |
| 3,688,245 | 8/1972 | Lockshaw | 339/256 S |

FOREIGN PATENT DOCUMENTS

| | | | |
|---|---|---|---|
| 409044 | 9/1966 | Switzerland | 339/256 S |
| 803640 | 10/1958 | United Kingdom | 339/256 S |
| 483731 | 12/1975 | U.S.S.R. | 339/256 S |

*Primary Examiner*—Neil Abrams

*Attorney, Agent, or Firm*—Keith D. Beecher

[57] ABSTRACT

An electrical contactor is provided which has particular although not exclusive utility in forming an electrical connection with a tungsten terminal pin such as is used in vacuum or gas-filled envelope enclosed high voltage relays; the contactor is in the form of a coil of resilient electrically-conductive material which grips the terminal pin in tight engagement therewith, and it serves as a solder tab for an electric wire to be connected to the terminal pin.

5 Claims, 4 Drawing Figures

ELECTRICAL CONTACTOR FOR TERMINAL PIN

BACKGROUND

The contactor may be used, for example, in conjunction with high voltage relays in which the movable and fixed contacts of the relay are mounted in a gas-filled envelope; and in which terminal pins extend through the envelope in radial directions, the terminal pins also serving as fixed contacts for the relay. The terminal pins are usually formed of tungsten, since that material is ideal insofar as the fixed contacts of the relay are concerned.

In the prior art relays of the type described in the preceding paragraph, connector tabs, usually formed of nickel, are spot welded to the terminal pins, and electrical connecting wires are soldered to the tabs. It has been found that the tungsten terminal pins are not a suitable material for spot welding due to the fact that they are formed by a sintering operation and their surfaces have a tendency to crumble. Therefore, not only is a relatively poor electrical contact established between the tabs and the terminal pins by the spot welds, but the tabs have a tendency to break off and come free from the terminal pins.

In accordance with the present invention, the spot welded tabs are replaced by spring-type connectors which have coiled portions wrapped around the terminal pins to grip the pins with a high pressure and which present a relatively large surface area to the pins as compared with the spot-welded tabs, for good electrical contact. The coiled portions of the connectors each has a first section which is wound in one direction about the terminal pin and a second section which is wound in the opposite direction. In this way, any tendency of the connector to turn about the axis of the terminal pin is one direction or the other produces a corresponding tightening of one of the coiled sections or the other, so that in either event the connector is held tightly on the terminal pin.

The connectors of the invention, as will be described, may be formed of any appropriate electrically conductive resilient material, such as beryllium copper or phosphor bronze wire; or they may be in the form of tabs each having oppositely coiled resilient sections which receive the corresponding terminal pin in a tight resilient fit.

DETAILED DESCRIPTION OF THE ILLUSTRATED EMBODIMENTS

Figure 1:
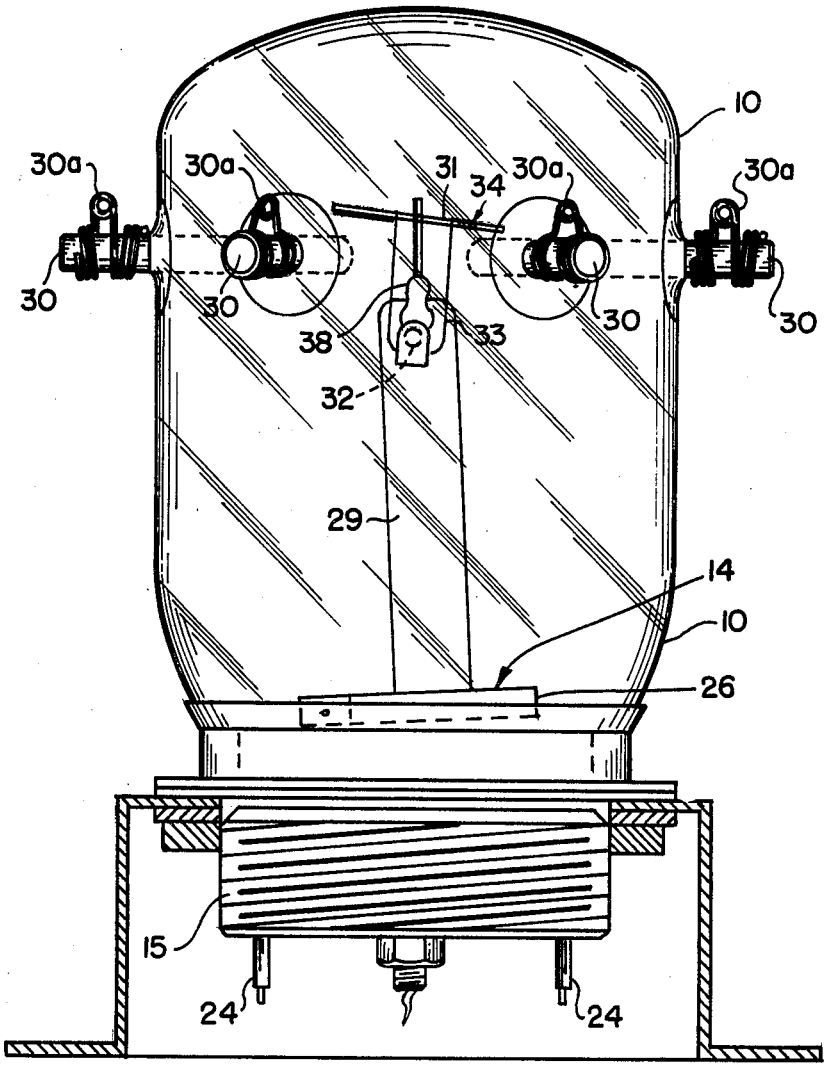
FIG. 1 is a side elevation, partly in section, of a relay which has radial terminal pins extending outwardly from its envelope, with connectors constructed in accordance with one embodiment of the present invention being mounted on the outer ends of the terminal pins.

The relay illustrated in FIG. 1 includes, for example, an envelope 10 which may be formed of glass or other suitable vitreous material. The envelope 10 may have a generally cylindrical configuration with a closed top and an open bottom. An armature assembly, designated generally as 14, is mounted in the envelope 10.

The armature assembly 14 includes a cylindrical-shaped member 15 formed of appropriate magnetic material. The cylindrical-shaped member 15 forms a housing, and the energizing coil of the relay is mounted within the housing. Appropriate terminals 24 are provided for the energizing coil.

The envelope is filled with an inert gas such as sulfur hexafluoride, or other inert gas or mixture of inert gases.

The armature assembly 14 includes a magnetic armature 26 which is hinged at one end, and which extends across the upper end of the core within housing 15. The armature assembly also includes a pair of upright support arms 29, which are welded, or otherwise affixed to the armature. The support arms 29 each has a slot 31 in its upper end, and when the relay is de-energized, armature 26 is biased in a counterclockwise direction so that the support arms 29 have an inclination as shown in FIG. 1. Then, when the relay is energized, the armature 26 is pulled down and the support arms 29 assume an upright position.

The relay assembly includes four terminal pins which are designated 30 in FIG. 1, and which extend through the envelope 10 in radial directions. The armature pins are preferably formed of sintered tungsten. The inner ends of the terminal pins serve as fixed contacts for the relay. A further pair of terminal pins designated 38 extends through the wall of enevelope 10 between the pins 30. The terminal pins 38 constitute the movable contact terminals for the relay in the double-pole double-throw embodiment shown in FIG. 1.

The selective connection between the pins 38 and the pins 30 is achieved by means of a pair of arcuate movable contacts 34, which are pivotally supported on the respective pins 38, and which are interconnected by means of a rod 32 composed of sapphire, or other appropriate insulating material.

As mentioned above, the prior art practice was to mount apertured connector tabs on the outer ends of the terminal pins 30 and 38 by spot welding the tabs to the pins. However, because of the composition of the pins, such connections have been found to be generally unsatisfactory.

Figure 2:
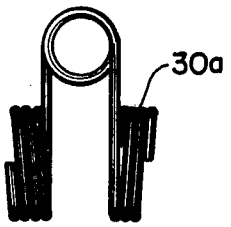
FIG. 2 is a representation of one of the connectors shown in FIG. 1.

In the practice of the present invention, connectors such as the connectors designated **30*a*, and shown more particularly in FIG. 2, are provided. The connectors 30*a* are each formed of a resilient electrically conductive wire, such as beryllium copper or phosphor bronze. The wires are configured to have two coaxial looped portions which are received on the corresponding pin in a tight relationship, so that good electrical connection is made between the contactor and the pin due to the large surface area. The contactor 30*a*** has a central portion, as shown, which is shaped to permit an electric wire to be soldered to the connector. The composition of the connector is such that it permits good solder contacts between it and the electric wire.

It will be appreciated that the looped portions of the connector, since they are wound in opposite directions, are such that any tendency for the connector to be turned about its corresponding terminal pin causes one or the other of the looped sections to tighten about the pin, so that there is no tendency for the connector to become loose and disconnected from the pin.

Figure 3A:
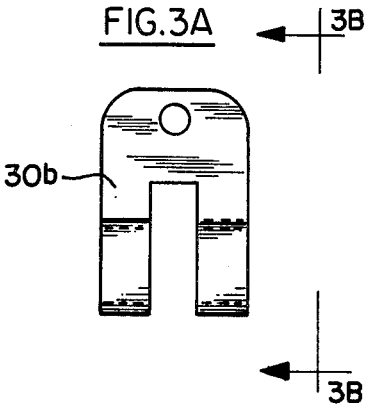
FIGS. 3A and 3B are plan and side views respectively of a second embodiment of the connector of the invention.
Figure 3B:
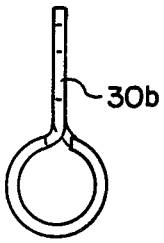

In the embodiment of FIGS. 3A and 3B a tab-like contactor **30*b* is provided which likewise may be formed of beryllium copper or phosphorous bronze, or other appropriate electrically conductive resilient material. The connector 30***b* has a flat tab-like portion, as shown, and it has an end portion which is formed of two coaxial looped sections. The looped sections, like the embodiment of FIG. 2, are turned in opposite directions, so that the connector 30*b* may be tightly held on the terminal pin, without any tendency for it to become loose or to fall off.

It will be appreciated that although two embodiments of the connector of the invention have been shown and described, modifications may be made. It is intended in the claims to cover all modifications which come within the true spirit and scope of the invention.

What is claimed is:

1. An electrical contact assembly comprising: a rigid electric terminal pin; an electrical connector to serve as a soldered tab for an electric wire to be connected to said terminal pin, said connector being formed of a resilient electrically-conductive material to which solder may be rigidly bonded and having a coiled portion adapted to fit over the electrical terminal pin in close fitting coaxial relationship therewith, said coiled portion including a first section wound in one direction and a second section coaxial with the first section and wound in the opposite direction, each of the first and second sections grippingly engaging said rigid terminal pin, and said connector having an exposed central portion shaped to permit an electric wire to be soldered to the connector.

2. The electrical connector defined in claim 1, in which the connector is formed of resilient wire.

3. The electrical connector defined in claim 1, in which the electrical connector has a tab-like portion having one end configured to form said coiled portion.

4. The electrical connector defined in claim 1, in which the electrical connector is formed of beryllium copper.

5. The electrical connector defined in claim 1, in which said connector is formed of phosphor bronze.

* * * * *